US011142430B2

(12) United States Patent
Roshto

(10) Patent No.: US 11,142,430 B2
(45) Date of Patent: Oct. 12, 2021

(54) ATTIC LIFT SYSTEM

(71) Applicant: Darryl Roshto, Walker, LA (US)

(72) Inventor: Darryl Roshto, Walker, LA (US)

( * ) Notice: Subject to any disclaimer, the term of this patent is extended or adjusted under 35 U.S.C. 154(b) by 0 days.

(21) Appl. No.: 15/214,147

(22) Filed: Jul. 19, 2016

(65) Prior Publication Data

US 2017/0022031 A1 Jan. 26, 2017

Related U.S. Application Data

(60) Provisional application No. 62/195,480, filed on Jul. 22, 2015.

(51) Int. Cl.
*B66B 9/00* (2006.01)

(52) U.S. Cl.
CPC ..... *B66B 9/00* (2013.01)

(58) Field of Classification Search
CPC ..... B66B 9/00
See application file for complete search history.

(56) References Cited

U.S. PATENT DOCUMENTS 2,499,791 A * 3/1950 Spencer ..... A47B 51/00 312/247
4,412,601 A * 11/1983 Cooper ..... B66B 9/00 187/261
5,535,852 A 7/1996 Bishop
7,575,098 B2 8/2009 Hartley
8,418,814 B1 4/2013 Byers
8,851,238 B2 10/2014 Byers
9,420,881 B2 * 8/2016 Reid ..... A47B 46/005
2006/0000675 A1 * 1/2006 Penn ..... B66B 9/00 182/142
2006/0066188 A1 * 3/2006 Crawford ..... A47B 51/00 312/247

FOREIGN PATENT DOCUMENTS

DE 102005007475 B3 * 8/2006 ..... B66B 7/02
WO 2011054991 A1 5/2011

OTHER PUBLICATIONS

English Machine Translation of DE 10 2005 007475.*

* cited by examiner

*Primary Examiner* — Diem M Tran
(74) *Attorney, Agent, or Firm* — Norton IP Law Firm LLC; Taylor M. Norton

(57) ABSTRACT

An attic lift system is provided, comprising a loading platform attached to a lifting frame having a plurality of vertical frame members, wherein the lifting frame includes a closure member positioned below the loading platform. The closure member includes a plurality of telescopic guide members, wherein the support frame is positioned on an attic floor above an opening in the attic floor. A plurality of support rods extend from the closure member and are threadably engaged with the vertical frame members of the lifting frame. A drive assembly is positioned on the support frame and connected to the lifting frame for raising and lowering the loading platform relative to the opening. Limit switches are present to detect when the drive assembly should be stopped based on the position of the lift platform.

11 Claims, 4 Drawing Sheets

ATTIC LIFT SYSTEM

CROSS-REFERENCE TO RELATED APPLICATIONS

This application claims priority under 35 U.S.C. 119 to provisional application Ser. No. 62/195,480, filed on Jul. 22, 2015.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

1. Field of the Invention

The invention relates generally to attic lift systems for moving objects to and from an attic, and more particularly to such systems which provide for automated control of the lifting motor based on the position of the lifting platform.

2. Description of Related Art

There is a common need to move items up stairs or ladders to a second level floor in a residence, such as an attic floor or second floor living space. For example, homeowners commonly store seasonal items, sporting goods, and other infrequently used tools in the attic to save space in other areas of the home. This task can be risky and difficult, because attic stairs are typically foldable, unstable, steep, and narrow, especially with heavy or bulky items.

Over the years, attic lift systems of varying types have been devised to avoid the risks and difficulties with attic stairs. Some of those systems are U.S. Pat. No. 2,499,791 to Spencer; U.S. Pat. No. 5,535,852 to Bishop; U.S. Pat. No. 7,575,098 to Hartley; and U.S. Pat. No. 8,418,814 and U.S. Pat. No. 8,851,238 to Byers. While these systems are useful in solving the problem of access, movement, and storage of attic items, they include various deficiencies based on complexity, costs to install, or convenience.

What is needed is an attic lift system that is relatively inexpensive to install, simply to operate, and safe to use. The lift system should enable a good seal against the ceiling when the lift system is in a raised position in the attic, as well as a loading platform that can be adjusted to be flush with the attic floor. Moreover, the lift system should provide a limit switch for automatically stopping the operation of the drive assembly when the lifting platform approaches either of its extreme positions when raising or lowering the platform. Finally, the lift system should provide sufficient stabilization to avoid sawying during operation, and ensure proper alignment between the platform and the attic opening.

SUMMARY OF THE INVENTION

Therefore, in a preferred embodiment, an attic lift system is provided, comprising a loading platform attached to a lifting frame having a plurality of vertical frame members, wherein the lifting frame includes a closure member positioned below the loading platform by a first distance from the loading platform; a plurality of telescopic guide members connected between the closure member and a support frame, wherein the support frame is positioned on a support structure above an opening in the support structure, wherein the support structure includes an upper surface and a lower surface separated by a second distance; a plurality of support rods extending from the closure member and threadably engaged with the vertical frame members of the lifting frame, wherein the first distance between the loading platform and the closure member can be adjusted to approximate the second distance between the upper surface and lower surface of the support structure; a drive assembly positioned on the support frame and operatively connected to the lifting frame for raising and lowering the loading platform relative to the opening; and a first limit switch operatively positioned on the closure member and in electrical communication with the drive assembly, for detecting when the closure member is adjacent to a floor, and causing the drive assembly to stop lowering the loading platform.

In another embodiment of the present invention, the drive assembly comprises a motor and winch having a tether connected to the lifting frame.

In a further embodiment, each of the vertical frame members is a tube which includes an internally threaded nut adapted to receive one of the support rods from the closure member.

In another embodiment, the telescopic guide members are adapted to minimize lateral movement of the loading platform.

In a preferred embodiment, the support rods are adjusted sufficient to cause the loading platform to be flush with the upper surface of the support structure when the lift system is in a fully raised position.

In another preferred embodiment, the invention further comprises a second limit switch positioned adjacent to the drive assembly and adapted to detect when the lifting frame reaches an upper limit corresponding to closure of the opening by the closure member, and to cause the drive assembly to stop raising the loading platform.

Preferably, the support rods are adjusted sufficient to cause the closure member to contact the lower surface of the support structure and fully close the opening when the lift system is in a fully raised position.

Further preferably, the invention further comprises a remote switch above the upper surface of the support structure for controlling the operation of the drive assembly, and a wall mounted switch below the lower surface of the support structure for controlling the operation of the drive assembly.

In another embodiment, the wall mounted switch further comprises a key lock-out device in communication with the wall mounted switch to prevent unauthorized operation of the drive assembly.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements.

DETAILED DESCRIPTION OF THE INVENTION

Before the subject invention is further described, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

In this specification and the appended claims, the singular forms "a," "an," and "the" include plural reference unless the context clearly dictates otherwise. Unless defined otherwise, all technical and scientific terms used herein have the same meaning as commonly understood to one of ordinary skill in the art to which this invention belongs.

Figure 1A:
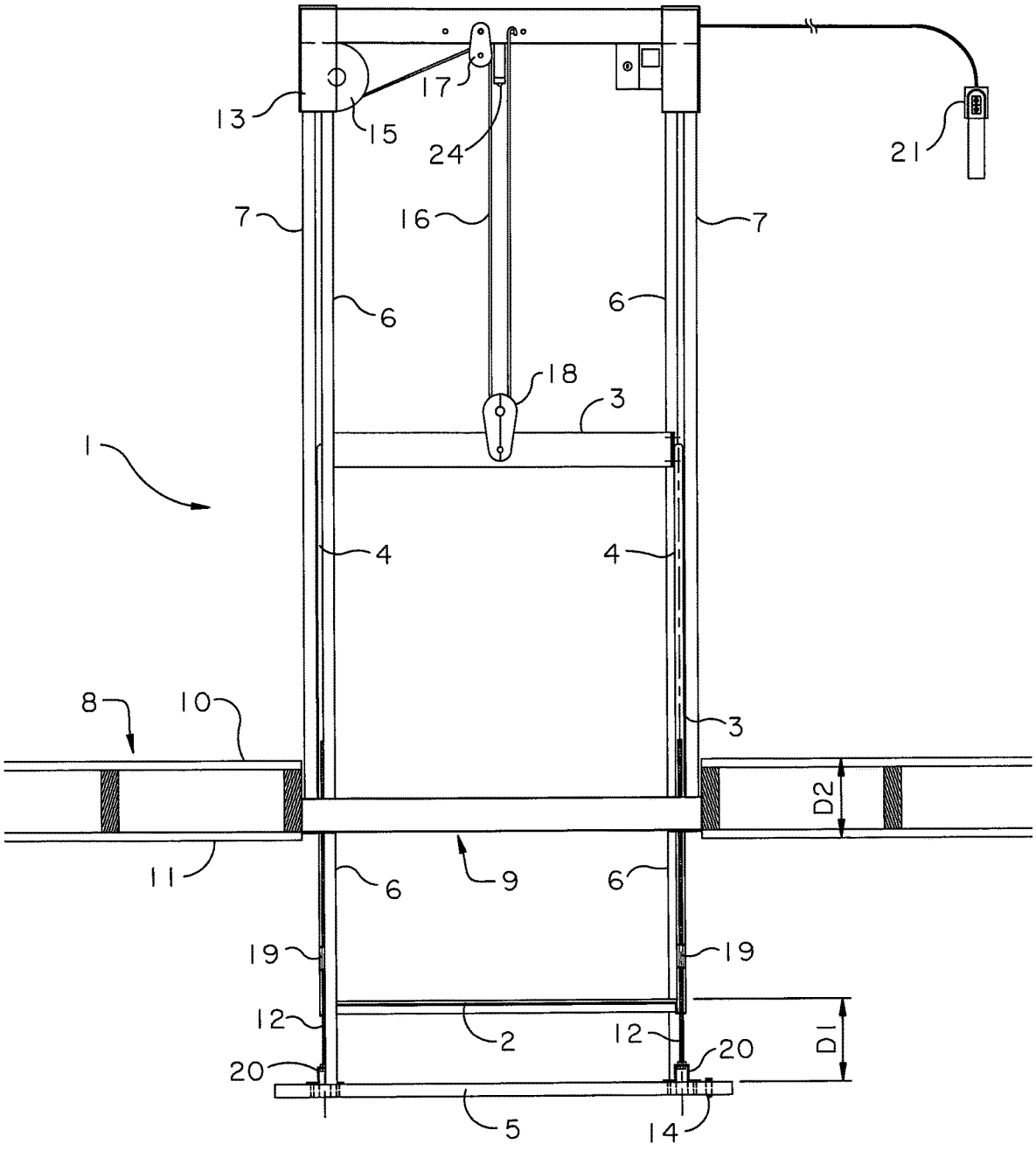
FIG. 1A depicts a side elevation view of a preferred embodiment of the lift system of the present invention showing the platform in a lowering position midway between a fully raised and fully lowered position.

Turning now to FIG. 1A, a side elevation view of a preferred embodiment of an attic lift system 1 is shown in a lowering position. A loading platform 2 is attached to a lifting frame 3 having a plurality of vertical frame members 4, wherein the lifting frame 3 includes a closure member 5 (serving as the door for the attic opening 9) positioned below the loading platform 2 by a first distance D1 from the loading platform 2.

A plurality of telescopic guide members 6 are connected between the closure member 5 and a support frame 7, wherein the support frame 7 is a rigid fixed frame positioned on a support structure 8 above an attic opening 9. The telescopic guide members 6 are constructed with sufficient structural rigidity to minimize lateral movement of the loading platform 2 during the raising or lowering operations.

The support structure 8 is generally the combination of joists, ceiling, and attic floor, and includes an upper surface 10 (typically the attic floor) and a lower surface 11 (typically the ceiling, which may comprise sheetrock) separated by a second distance D2.

Figure 1B:
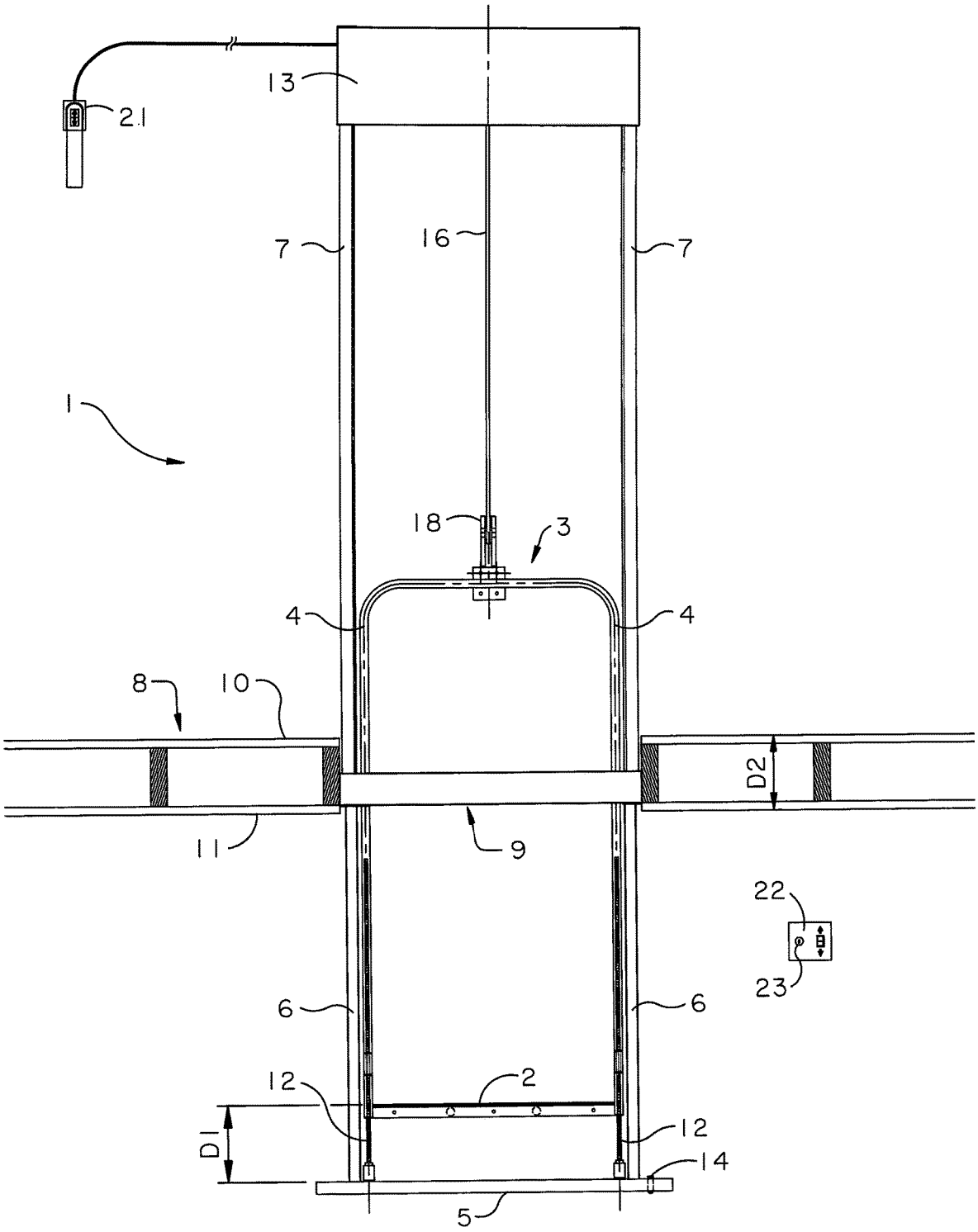
FIG. 1B depicts a front elevation view of the embodiment of FIG. 1A, also showing the lift system in a lowering position.

As best shown in the front view of FIG. 1B, which also depicts the lift system in a lowering position similar to FIG. 1A, a plurality of support rods 12 extend from the closure member 5 and are threadably engaged with the vertical frame members 4 of the lifting frame 3, wherein the first distance D1 between the loading platform 2 and the closure member 5 can be adjusted to approximate the second distance D2 between the upper surface 10 and lower surface 11 of the support structure 8.

A drive assembly 13 is positioned on the support frame 7 and operatively connected to the lifting frame 3 for raising and lowering the loading platform 2 relative to the opening 9. In a preferred embodiment, the drive assembly 13 comprises a motor and winch combination 15 having a tether or cable 16 passing through a guide pulley 17 and then a lifting pulley 18 attached to the top of the lifting frame 3. The drive assembly may be optionally covered by an outer cage constructed of plastic or sheet metal.

A first limit switch 14, such as a micro plunger or optical switch, is operatively positioned on the closure member 5 and in electrical communication with the drive assembly 13, for detecting when the closure member 5 is adjacent to a ground floor G, and causing the drive assembly 13 to stop lowering the loading platform 2. The limit switch 14 can communicate with the drive assembly 13 either by wires or wirelessly, such as through a module and relay mounted in a junction box located on the support frame 7 and electrically connected to the motor and winch 15.

A second limit switch 24, such as a mini plunger or optical switch, is operatively positioned adjacent to the drive assembly 13 to detect when the lifting frame 3 reaches an upper limit (such as by the lifting frame contacting the limit switch 24) corresponding to closure of the opening 9 by the closure member 5, and to cause the drive assembly 13 to stop raising the loading platform 2. The limit switch 24 can communicate electrically with the drive assembly 13 similar to the manner in which limit switch 14 communicates with the drive assembly 13. During installation of the lift system, the precise locations, positions, and sensitivities of the limit switches 14, 24 can be set to accommodate the specific installation environment for proper operation.

With respect to the lifting frame 3, each of the four vertical frame members 4 is a tube which includes an internally threaded nut 19 adapted to receive one of the four externally threaded support rods 12 extending from the closure member 5. The support rods 12 are retained by brackets 20 which are mounted by screws to the closure member 5. Each threaded support rod 12 includes a head which can be gripped and adjusted by a socket wrench through an adjustment hole cut into the closure member 5. The adjustment holes can be covered with caps when adjustments are done for a finished look. With this design, the support rods 12 can be turned and threaded against the nut 19 to increase or decrease the first distance D1 between the closure member 5 and the loading platform 2. For example, because the second distance D2 is known for any given installation, the support rods 12 can be adjusted sufficient to cause the loading platform 2 to be flush with the upper surface 10 of the attic floor when the lift system is in a fully raised position. At the same time, adjustment of the support rods 12 will cause the closure member 5 to contact the lower surface 11 (ceiling) of the support structure 8 to fully close the opening 9 when the lift system is in a fully raised position.

For operation of the lift system, and with further reference to FIG. 1B, and for the convenience of the user, a remote switch 21 can be located above the upper surface 10 of the support structure 8 for controlling the operation of the drive assembly 13 when the user is in the attic or second floor. Similarly, a wall mounted switch 22 can be located on a wall below the lower surface 11 of the support structure 8, such as the first floor, for controlling the operation of the drive assembly 13. Optionally, a key lock-out device 23 may also be provided in communication with the wall mounted switch 22 to prevent unauthorized operation of the drive assembly 13.

Figure 1C:
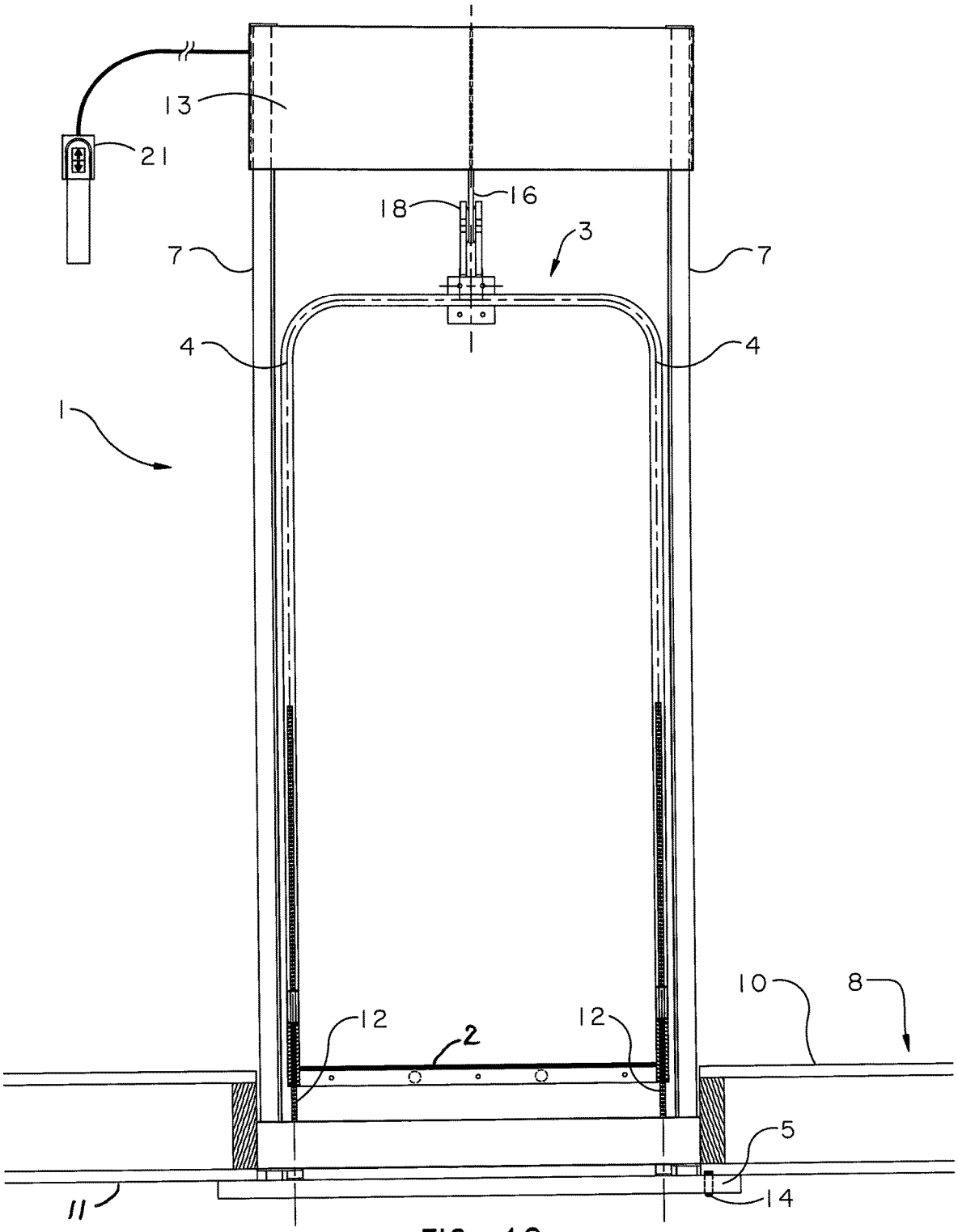
FIG. 1C depicts a front elevation view of the embodiment of FIG. 1A in a fully raised position.

FIG. 1C depicts the lift system in a fully raised position, wherein the closure member 5 establishes a close fit to the ceiling 11, and wherein the loading platform 2 is substantially flush with the attic floor 10 for ease of loading and unloading. In this position, the telescopic guide members 6 are in their fully retracted state.

Figure 1D:
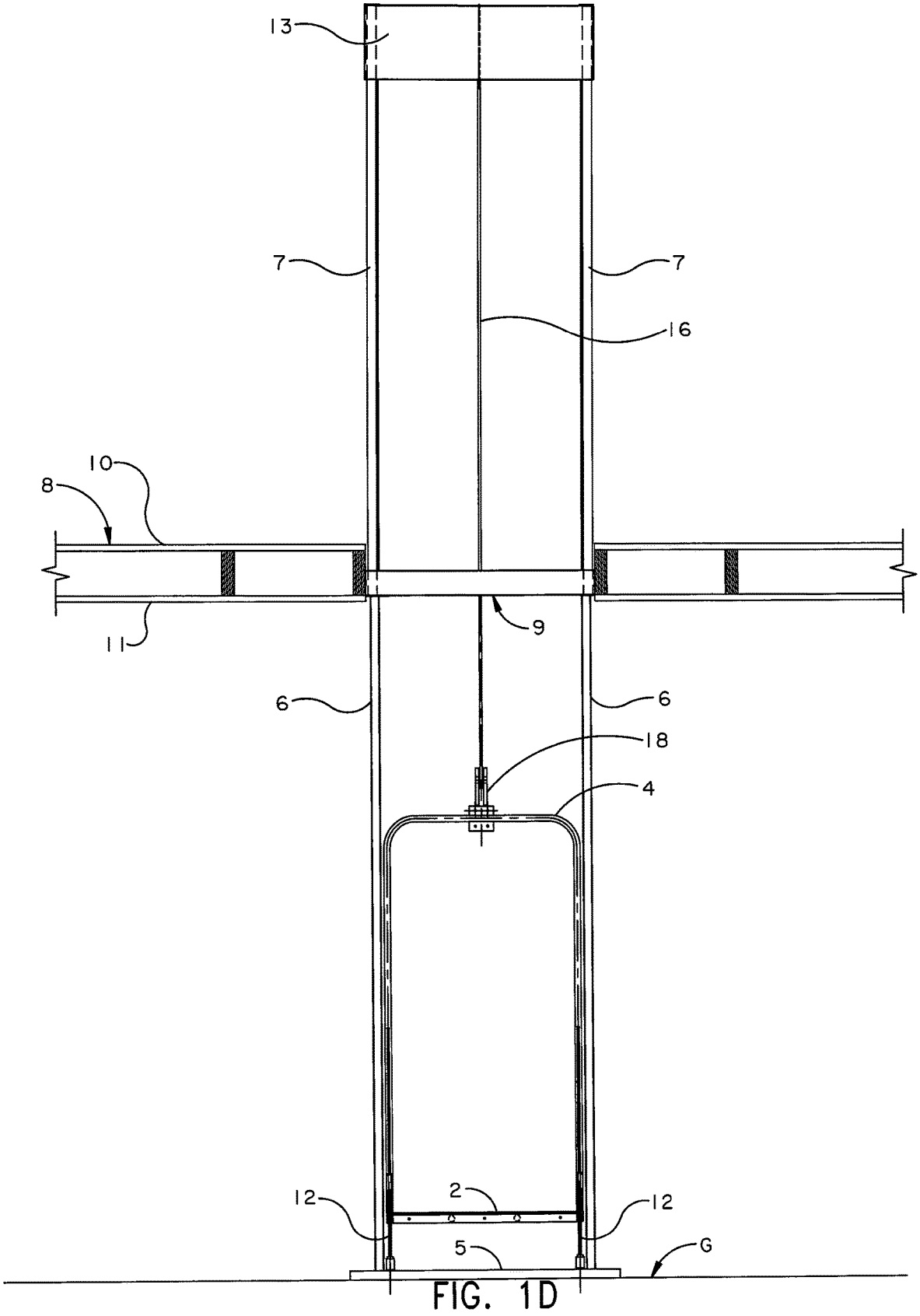
FIG. 1D depicts a front elevation view of the embodiment of FIG. 1A in a fully lowered position.

FIG. 1D depicts the lift system in a fully lowered position, wherein the closure member 5 rests on the ground floor G, and wherein the telescopic guide members 6 are in their fully extended state.

All references cited in this specification are herein incorporated by reference as though each reference was specifically and individually indicated to be incorporated by reference. The citation of any reference is for its disclosure prior to the filing date and should not be construed as an admission that the present invention is not entitled to antedate such reference by virtue of prior invention.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. An attic lift system, comprising:

a lifting frame having a plurality of elongated vertical frame tubes, each of said elongated vertical frame tubes respectively comprising an internally threaded nut;

a loading platform fixed to a bottom end of each respective elongated vertical frame tube of the lifting frame;

a plurality of elongated externally threaded support rods threadedly engaged within the respective internally threaded nuts of the plurality of elongated vertical frame tubes of the lifting frame, the plurality of elongated externally threaded support rods respectively extending into and outwardly from the plurality of elongated vertical frame tubes, configured at the option of a user;

a closure member adapted to close an attic opening defined by a ceiling of a room when the attic lift system is in a fully raised position wherein the loading platform is substantially flush with an attic floor above the attic opening, the closure member rigidly suspended by the plurality of externally threaded support rods below the loading platform at a distance adapted to be set by the user, the closure member having a plurality of retention brackets mounted thereon, said plurality of retention brackets operatively connected to the respective plurality of externally threaded support rods such that a rotation of the plurality of elongated externally threaded support rods by the user in a first direction increases the distance between the closure member and the loading platform and such that an opposite rotation of the plurality of externally threaded support rods by the user in a second direction opposite the first direction decreases the distance between the closure member and the loading platform;

a plurality of telescopic guide members connected to the closure member and a support frame, wherein the support frame is positioned on the attic floor above an the attic opening;

a drive assembly positioned on the support frame and operatively connected to the lifting frame for raising and lowering the loading platform relative to the attic opening; and a first limit switch operatively positioned on the closure member and in electrical communication with the drive assembly, for detecting when the closure member is adjacent to a room floor, and causing the drive assembly to stop lowering the loading platform.

2. The system of claim 1, wherein the drive assembly comprises a motor and winch having a tether connected to the lifting frame.

3. The system of claim 1, wherein the distance set by the user is a difference in height between the ceiling of the room and the attic floor, wherein the distance is adapted to be set by the user when the attic lift system is not in the fully raised position.

4. The system of claim 1, wherein the telescopic guide members are adapted to minimize lateral movement of the loading platform.

5. The system of claim 1, wherein each elongated externally threaded support rod of the plurality of elongated externally threaded support rods comprises a respective head adapted to be gripped by a socket wrench of a user through an adjustment hole defined by the closure member such that the plurality of elongated externally threaded support rods are adjustably rotated to a position sufficient to cause the loading platform to be flush with the an upper surface of the attic floor when the lift system is in a fully raised position.

6. The system of claim 1, further comprising a second limit switch positioned adjacent to the drive assembly and adapted to detect when the lifting frame reaches an upper limit corresponding to closure of the attic opening by the closure member, and to cause the drive assembly to stop raising the loading platform.

7. The system of claim 1, wherein the plurality of elongated externally threaded support rods are adjusted sufficient to cause the closure member to contact the ceiling and fully close the attic opening when the lift system is in a fully raised position.

8. The system of claim 1, further comprising a remote switch disposed above the an upper surface of the support structure for controlling an operation of the drive assembly.

9. The system of claim 1, further comprising a wall mounted switch disposed below the ceiling for controlling an operation of the drive assembly.

10. The system of claim 9, further comprising a key lock-out device in communication with the wall mounted switch to prevent unauthorized operation of the drive assembly.

11. The system of claim 1, wherein the distance set by the user is a difference in height between the ceiling of the room and the attic floor, wherein the distance is adapted to be set by the user when the attic lift system is in the fully raised position.

* * * * *